US005437780A

United States Patent [19]

Southard et al.

[11] Patent Number: 5,437,780

[45] Date of Patent: * Aug. 1, 1995

[54] PROCESS FOR MAKING SOLVATED MESOPHASE PITCH

[75] Inventors: W. Mark Southard; H. Ernest Romine; Edward J. Nanni; Mark W. Carel, all of Ponca City, Okla.

[73] Assignee: Conoco Inc., Ponca City, Okla.

[ * ] Notice: The portion of the term of this patent subsequent to Nov. 9, 2010 has been disclaimed.

[21] Appl. No.: 135,204

[22] Filed: Oct. 12, 1993

[51] Int. Cl.[6] ..... C01C 3/02

[52] U.S. Cl. ..... 208/45; 208/22; 208/39; 208/44

[58] Field of Search ..... 208/39, 22, 44, 45

[56] References Cited

U.S. PATENT DOCUMENTS

| | | | |
|---|---|---|---|
| 4,184,942 | 1/1980 | Angier | 208/44 |
| 4,208,267 | 6/1980 | Diefendorf | 208/22 |
| 4,271,006 | 6/1981 | Dickakian | 208/41 |
| 4,277,324 | 7/1981 | Greenwood | 208/45 |
| 4,283,269 | 8/1981 | Greenwood | 208/45 |
| 4,533,461 | 8/1985 | Izumi et al. | 208/44 |
| 4,904,371 | 2/1990 | Kalbeck | 208/39 |
| 5,032,250 | 7/1991 | Romine et al. | 208/45 |
| 5,091,072 | 2/1992 | Tsuchitani et al. | 208/39 |
| 5,182,010 | 1/1993 | Mochida et al. | 208/44 |
| 5,182,011 | 1/1993 | Tsuchitani et al. | 208/45 |
| 5,259,947 | 11/1993 | Kalback et al. | 208/44 |

OTHER PUBLICATIONS

Japanese Patents: No.: Japan No. Sho 54(1979)-160427; No. Sho 58(1983)-214531; No. Sho 58 (1983)-196292 No. Sho 58(1983)-136835; No. Sho 57 (1982)-119984.

*Primary Examiner*—Helane Myers

[57] ABSTRACT

This invention relates to a process for producing mesophase pitch in high yields. The process of the invention comprises isolating a heavy fraction of a heat soaked pitch by a solvent extraction, heat soaking the isolated heavy fraction to increase the size and number of larger heavy aromatics, and isolating the larger heavy aromatics by solvent extraction to obtain a larger heavy aromatic solvated mesophase pitch.

35 Claims, 1 Drawing Sheet

PROCESS FOR MAKING SOLVATED MESOPHASE PITCH

FIELD OF THE INVENTION

This application relate to an improved process for making solvated mesophase pitch. By following the process of the invention, solvated mesophase pitch, and especially thermosetting solvated pitch, may be produced in higher yields and with greater operability than can be achieved using other processes known in the art.

BACKGROUND OF THE INVENTION

Mesophase pitch is a carbonaceous material possessing an ordered liquid crystalline structure. It is believed that it is the liquid crystalline structure of mesophase pitch which lends superior physical properties to carbon artifacts, especially fibers, made therefrom.

Various processes for making mesophase pitch are well known in the art. One such process is disclosed in U.S. Pat. No. 4,208,267 (Diefendorf) wherein solvent fractionation is used to obtain a mesophase former fraction with a quinoline insolubles (QI) content of less than 25%. The Diefendorf patent teaches treating an isotropic pitch with a solvent to provide a solvent insoluble fraction having a sintering point below 350° C. and separating the solvent insoluble fraction from the solvent solution. The solvent insoluble fraction is then heated to a temperature of from 230°–400° C. in order to convert the insoluble fraction to a deformable pitch containing greater than 75% mesophase.

U.S. Pat. No. 4,277,324 (Greenwood) teaches that QI and high softening temperature components are undesirable in a pitch intended for spinning and can be removed from a pitch by a solvent extraction process. In the Greenwood process a flux liquid (solvent) is added to the pitch to make the pitch fluid and suspend any insoluble pitch particles in the solution. The suspended particles are removed from the solution and the solution is treated with a second liquid (antisolvent) to cause a substantial portion of the fluid pitch to precipitate. The precipitated pitch is then removed from the fluid and used to make carbon artifacts.

U.S. Pat. No. 4,184,942 (Angier) teaches heat soaking of a low QI isotropic pitch to increase the amount of neomesophase former fraction in the pitch. After heat soaking, the neomesophase former fraction is isolated by solvent extraction.

Pat. No. 5,259,947 discloses a solvated mesophase pitch with improved handling characteristics. Because the solvated mesophase pitch melts at a temperature at least 40° C. lower than the same pitch in non-solvated form, the solvated pitch may be successfully processed and spun at a lower temperature. Also, spinnable solvated pitches can be prepared from heavy aromatic pitches that are otherwise unsuitable, or that melt above 350° C. where carbonizing occurs making these pitches unsuitable for spinning. Thus solvated mesophase effectively increases the range of heavy aromatics yielding a useable pitch. Because of this new utility of heavy pitch fractions, it is desirable to obtain such heavy fractions by an operable process having goo yields.

Typical heat soaking techniques (i.e., increasing the severity of the heat soak conditions) were tested in an attempt to increase the yield of heavy mesophase-forming aromatic pitch has some severe drawbacks. Although increasing the severity of the heat soak will usually increase the yield of heavy mesophase-forming aromatic pitch, the process will typically produce a two-phase product comprising an isotropic phase pitch and a mesophase pitch. Two phase pitch products are notoriously difficult to process, especially when a continuous processing system is employed where transfer of the two phase mixture is required. Typically, the two phases have disparate physical properties, e.g. molecular weight, viscosity, density, and melting point. During the heat soak process the mesophase portion tends to become very viscous, and eventually carbonizes inside the processing equipment, ultimately reaching a solid coke state. The viscous mesophase and/or solid coke will foul furnaces, transfer lines, associated vessels, and equipment. Even if the process is not taken this far, slight carbonization of the pitch is likely to introduce unmeltable contaminants in the mesophase pitch product. On the other hand, if heat soaking conditions are kept mild to avoid forming a two phase mesophase containing heat soaked pitch, the potential yield of heavy solvated mesogens is undesirably low. The present invention seeks to avoid the processing problems as outlined above and in addition, improve the yield of the desired mesophase pitch product.

SUMMARY OF THE INVENTION

The present invention comprises a highly operable process for obtaining heavy solvated pitches in high yields. In its most basic form, the invention comprises heat soaking a heavy aromatic pitch fraction in the presence of a solvating solvent and recovering the larger heavy aromatics produced by this heat soaking. The heat soaking step and the recovering step may be carried out as consecutive steps. Alternatively, the steps of heat soaking the heavy aromatic fraction and recovering the larger heavy aromatics may be carried out simultaneously.

A particularly useful aspect of the present invention resides in preparing thermosetting solvated mesophase pitches. The thermosetting solvated mesophase pitches are meltable and flowable when solvated, but yield thermosetting heavy hydrocarbon residue when the solvating solvent is absent from the pitch. Upon heating thermosetting solvated mesophase pitches convert to an infusible carbonaceous material without appreciably melting.

BRIEF DESCRIPTION OF THE DRAWING

The drawing is a flow diagram illustrating a continuous process for converting an aromatic feedstock to a solvated mesophase pitch.

DETAILED DESCRIPTION OF THE INVENTION

Figure 1:
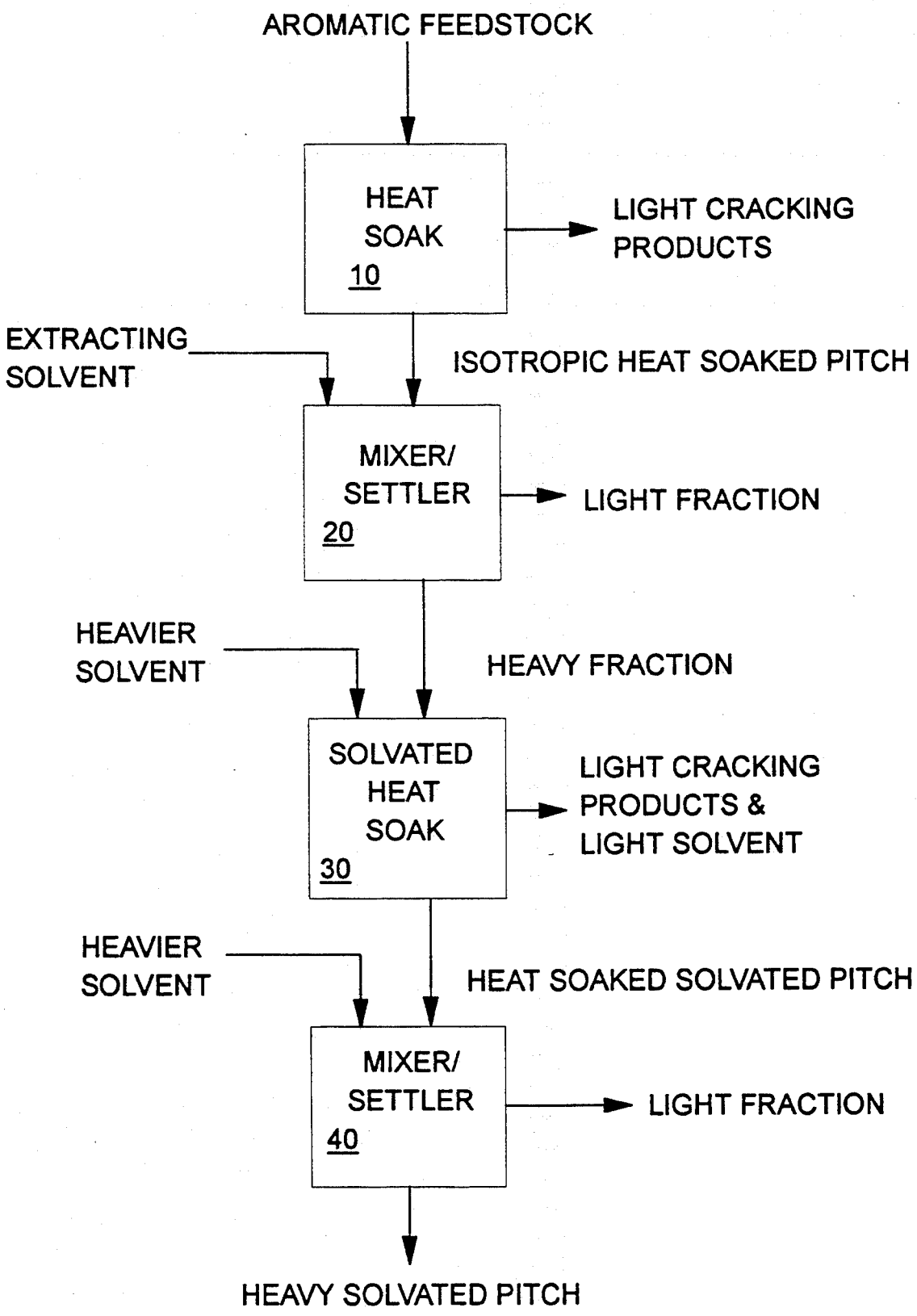

The present invention comprises a highly operable process for obtaining heavy solvated mesophase pitches from heavy pitches in high yields. The invention comprises the steps of:

heat soaking a heavy aromatic pitch fraction in the presence of a solvating solvent under conditions suitable for forming larger heavy aromatic molecules; and recovering the larger heavy aromatic solvated pitch molecules produced in heat soaking.

The heavy aromatic pitch fraction which is used as a feedstock of the invention is a mixture of graphitizable aromatic hydrocarbons comprising mesophase pitch or mesophase containing pitches with little or no ash contamination. In the dry (non-solvated) state the heavy aromatic pitch fraction will soften in the range of 150°–400° C. Preferably, the pitch fraction will melt below 400° C. Some types of mesophase pitches and mesophase containing pitches may not make suitable feedstocks for use in this invention. Unsuitable feedstocks include certain thermal and thermal sparge mesophases, wherein a portion of these materials remains a non-meltable solid when the pitch is combined with a solvating solvent.

The heavy aromatic pitch fraction can be purchased commercially. For example, a heavy aromatic pitch feed suitable for use in this invention is commercially available from Mitsubishi Gas Chemical Company, Inc. (Tokyo, Japan) and is sold as ARA 240 synthetic mesophase pitch. As will be seen later in this document, the heavy aromatic pitch fraction may also be obtained from a heat soaked aromatic feedstock.

Heat soaking of the heavy aromatic pitch fraction in the process of the invention is conducted in the presence of a solvating solvent and under conditions suitable for promoting the increase in the number of desired large aromatic molecules in the pitch. Such conditions include subjecting the heavy aromatic pitch fraction to temperatures in the range of from 360°–520° C. and a pressure sufficient to maintain the solvating solvent in a liquid state at the selected temperature. Such pressures generally are in the range of 14.7–1000 psia for a period of time of from 5 minutes to 24 hours. The preferable temperature for the heat soak of the heavy fraction is in the range of 380°–460° C.

It is critical to the invention that the step of heat soaking the heavy aromatic pitch fraction be conducted in the presence of a solvating solvent. Generally this requires conducting the heat soak step in a closed container or other suitable system which keeps the solvating solvent in intimate contact with the pitch being heat soaked. A closed container will also allow the pressure to build to the desired range in order to carry out the process of the invention.

The solvating solvent used in the heat soaking step is a solvent which, when combined with the heavy pitch fraction, dissolves in the heavy pitch fraction to an extent sufficient to form a solvated pitch. The solvated pitch formed by combination with the solvating solvent melts or flows at a temperature at least 40° C. lower than the melting temperature of the non-solvated form of the same pitch fraction.

Suitable solvating solvents of the present invention comprise one or more solvent selected from the group consisting of organic solvents having a structure comprising 1–4 aromatic rings wherein such structure may optionally include 1, 2 or 3 hydroaromatic rings. The structure of the solvent may optionally be substituted with one or more substituents selected from the group consisting of $C_1$–$C_4$ alkyl groups (i.e., methyl, ethyl, propyl and butyl groups). The preferred solvents have an average solubility parameter (8) in the range of 7.0–11.5.

Specific solvating solvents which may be used in this invention comprise one or more solvents selected from the group consisting of benzene, xylene, anthracene, phenanthrene, chrysene, pyrene, tetralin, and naphthalene. Naturally occurring aromatic distillates comprising solvating solvents having structures as described in the preceding paragraph may also be used as the solvating solvent of the invention. Such distillates may be obtained from petroleum aromatics, coal tars, and ethylene tars.

During the heat soaking of the heavy aromatic pitch fraction the solvating solvent is present in a solvent to pitch ratio in the range of from 0.05–5.0 parts solvent per part of pitch. At the point of saturation of the pitch, up to about 40%, but typically about 20–25%, by weight solvating solvent can be dissolved in the heavy pitch fraction. At the saturation point, a solvated pitch can melt at a temperature which is 200° C. or more lower than the melting point of that pitch in nonsolvated form. This lowering of the melting temperature assures that the very heavy pitch fractions, including the desired thermosetting fractions, remain highly fluid and processable during the heat soak.

The recovery of the larger heavy aromatics produced by heat soaking is typically carried out using a solvent extraction technique. The products of the heat soaking step are placed in intimate contact with an extraction solvent at an elevated temperature in order to separate the materials into a solvated residue containing the larger heavy aromatics, which is recovered, and the liquid extract, which is removed. The extraction is usually carried out in a closed container in order to retain the solvent in the system and to allow the pressure within the system to reach desired levels so that the solvent may remain in the liquid state at the extraction temperature. While the exact pressure necessary to carry out the extraction will vary depending on the solvent or solvents used, the range of pressures adequate to carry out this step of the process reside in the range of from 14.7–1000 psia. Extracting the larger heavy aromatics produced in the solvated heat soak is done at solvent to pitch ratios of from 0.25–5.0 parts of solvent per part of pitch. Practitioners in the art will appreciate that when the desired result is just extraction, the extraction temperature should be kept below the reaction temperature of the pitch. The temperature at which the extraction alone is carried out can range from about 200°–400° C.

The conditions at which the extraction is conducted are selected in order to attain a desired hardness in the larger heavy aromatics in the insoluble pitch fraction. As a general rule, using solvents with a higher solubility parameter, and high solvent/pitch ratios in the extraction process yield harder, higher melting insolubles. However, these conditions generally also foster lower yields of the harder products.

The desired larger heavy aromatics, when dried of solvent, soften at 350° C. or above. At these temperatures the dry larger heavy aromatics convert to coke at an appreciable rate. Preferably, the larger heavy aromatics soften above 450° C., or 500° C. Generally, the larger heavy aromatics which soften above 500° C. are thermosetting, that is, if they soften at all they tend to solidify quickly thereafter as the pitch undergoes thermal reaction and becomes unmeltable. Therefore, when dried of solvent the larger heavy aromatics may never fully melt.

The heavy solvated pitch products of this invention comprise larger heavy aromatic molecules and solvating solvent. The larger heavy aromatic molecules have dry softening temperatures above 350° C. preferably above 450° C. and most preferably above 500° C. The heavy aromatic pitch fraction which is used as the feed stock for the solvated heat soaking step of the invention comprises softer materials which soften generally in the range of 150°–400° C. Preferably, the heavy aromatic pitch fraction also melts below 400° C. to allow handling in the molten state without appreciable coking.

The softening and melting temperature of dry pitch is determined by hot stage microscopy. Using this technique, a sample of pitch is crushed to a size of approximately 200 or less and thinly distributed in an aluminum pan. The sample is heated on a Leitz 1350 hot stage under a slight nitrogen purge with the temperature programmed to increase at the rate of 20° C. per minute after a rapid initial heatup to 250° C. The softening temperature is recorded as the temperature at which 10% of the pitch particles exhibit rounding of points and edges. A change in surface luster is also noticeable. The melting temperature is determined when the flow or spreading of fluid pitch is first observed around the particles. Melting typically occurs 10°–50° C. above the softening temperature.

Whether or not thermosetting of the pitch is observed appears to depend on the rate of heating of the sample and the thermal reaction rate of the pitch. Thermosetting is observed when the rate of thermal reaction of the pitch exceeds the heating rate of the pitch. Therefore, at high heating rates observing thermosetting is less likely, while at low heating rates observing thermosetting is more likely. It has also been noted that higher softening point pitches display thermosetting behavior at faster heating rates since the thermal reaction will be faster in these pitches at the higher temperatures achieved without melting.

The same higher boiling solvating solvents described for use in the heat soaking of the heavy pitch fraction are suitable for use as the extraction solvents in recovering the larger heavy aromatics produced by heat soaking. Suitable extraction solvents of the present invention comprise one or more solvents selected from the group consisting of organic solvents having a structure comprising 1–4 aromatic rings wherein such structure may optionally include 1, 2 or 3 hydroaromatic rings. The structure of the solvent may optionally be substituted with one or more substituents selected from the group consisting of $C_1$–$C_4$ alkyl groups (i.e., methyl, ethyl, propyl and butyl groups). The preferred solvents have a solubility parameter ($\delta$) in the range of 7.0–11.5.

Specific extraction solvents which may be used in this invention comprise one or more solvents selected from the group consisting of benzene, xylene, anthracene, phenanthrene, chrysene, pyrene, tetralin, and naphthalene. Naturally occurring aromatic distillates comprising extraction solvents having structures as described in the preceding paragraph may also be used as the extraction solvent of the invention. Such distillates may be obtained from such sources as petroleum aromatics, coal tars, and ethylene tars.

The step of heat soaking the heavy aromatic pitch fraction in the presence of a solvating solvent and the step of extracting the larger heavy aromatics produced in the heat soaking of the heavy aromatics may optionally be combined into a single step so that heat soaking the pitch and extracting the heavy aromatics occur at the same time. When the two steps are combined the solvent to pitch ratio must be maintained at sufficient levels to allow both the solvating and extracting steps to occur concurrently. A solvent to pitch ratio in the range of from 0.25–5.0 parts solvent per part pitch is required when the steps are combined. The temperature of the process should be maintained in the heat soak temperature range, that is, for 360°–520° C., with 380°–460° C. preferred. The pressure of the process should be maintained at a pressure sufficient to maintain the solvent in the liquid state while at the process temperature. Generally, a pressure in the range of 14.7–1000 psia will be sufficient.

During the process of heat soaking and recovering the larger heavy aromatic molecules it is desirable to maintain the pitch and solvent in a reasonably homogeneous mixture. This can be accomplished simply by the boiling action of the solvent and pitch mixture being heated, or mechanically through the use of such means for mixing such as stirrers, paddles, agitators, and pump around loops, for example.

The invention may also be practiced by starting with an aromatic feedstock and processing the feedstock to obtain the desired heavy pitch fraction and treating the heavy pitch fraction as described above. In this instance, the process of the invention comprises the steps of:

heat soaking an aromatic feedstock to obtain an isotropic heat soaked pitch therefrom which comprises a heavy pitch fraction;

extracting and isolating a heavy pitch fraction of the isotropic heat soaked pitch using a suitable solvent;

heat soaking the heavy pitch fraction in the presence of a solvating solvent under conditions suitable to promote the formation of larger heavy aromatic molecules; and recovering the larger heavy aromatic molecules produced in heat soaking the heavy fraction.

It will be appreciated by the practitioners of the art that the steps involving the heat soaking of the aromatic feedstock to produce a heat soaked isotropic pitch and the extraction of a heavy fraction of the heat soaked pitch utilize techniques which are largely conventional. The process details of these steps are set forth below.

The aromatic feedstock from which the heavy aromatic fraction is obtained is typically a mixture of aromatic hydrocarbons obtained either as a residue or distillate of a petroleum refining process. Preferably, the feedstock is a distillate cut derived from a coal tar, gas oil, or a coker feed, such as refinery decant oils, thermal cracking tars, and ethylene pyrolysis tars. It will be appreciated by those skilled in the art that the ideal feedstocks will be very low in ash and other particulate contaminants.

The heat soaking treatment of the aromatic feedstock is intended to produce an isotropic heat soaked pitch. This heat soak treatment is carried out at a temperature in the range of from 360°–570° C. for a period from 2 minutes to 48 hours and at pressures from about atmospheric up to 900 psia. The pressure applied during this heat soaking step is sufficient to ensure that substantial amounts of lower boiling petroleum oils in the feedstock are not volatilized in the heat soaking process.

The solvent extraction and isolation of the heavy fraction of the heat soaked isotropic pitch are carried out by conventional means with a solvent or blend of solvents having a nonpolar solubility parameter ($\delta$) ranging from 7–10. One and two ring aromatic and hydroaromatic hydrocarbons, which may be unsubstituted, or substituted with short chain alkyl groups are suitable solvents for the extraction step. Preferably, the solvents are selected from the group consisting of toluene, xylene, mesitylene, naphthalene, tetralin, and alkyl-substituted benzenes of the formula:

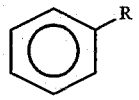

wherein R represents alkyl groups of $C_1$–$C_4$, which may be straight or branched, and substituted or unsubstituted. Blends of these aromatic or hydroaromatic solvents with non-aromatics, such as paraffins and cycloparaffins, also make suitable solvents. For example, heptane and cyclohexane are suitable non-aromatic solvent blend components.

The extraction of isotropic pitch can be carried out at ambient or elevated conditions of temperature and pressure. Preferably, elevated temperatures of 150°–350° C. are used in conjunction with sufficient pressure to maintain the solvent as liquid. Solvent supercritical conditions of temperature and pressure may also be used for extraction of the isotropic pitch.

The amount of solvent used in this extraction step is from about 2–20 parts of solvent per part of pitch. Preferably, 3–8 parts of solvent per one part of pitch are used to extract the heavy fraction. The heavy pitch fraction thus obtained by the process is a mixture of graphitizable aromatic hydrocarbons. The preferred heavy pitch fractions are mesophase pitches or mesophase containing pitches with little or no ash contamination.

After the extracting and isolating step, an amount of the extraction solvent will be retained by the pitch. When the desired solvating solvent for the heavy pitch fraction is different from the solvent used in the extraction and isolation of the heavy pitch fraction the heavy pitch fraction may require slightly different processing. The solvent used in the extraction to obtain the heavy pitch fraction may be removed by such techniques as vacuum stripping, and then the desired solvating solvent can be added. Alternatively, when the desired solvating solvent has a higher boiling temperature, the container in which the pitch is being processed may simply be vented at an appropriate temperature to allow the lower boiling solvent to escape.

The steps of heat soaking the aromatic feedstock and extracting and isolating the heavy pitch fraction yield the feedstock for use in the solvated heat soaking step which follows. It will be appreciated that the steps of heat soaking the heavy pitch fraction in the presence of a solvating solvent and the recovery of the larger heavy aromatic molecules are the same as previously described above.

The invention can be practiced in batch amounts, or in a continuous process as shown in FIG. 1. In FIG. 1, a flow diagram is presented illustrating a continuous process by which an aromatic feedstock is converted to a solvated mesophase pitch. In FIG. 1, aromatic feedstock is transferred from storage to a heat soaking furnace 10 and is converted into an isotropic heat soaked pitch and a small amount of light cracking products. The heat soaked isotropic pitch is combined with the extraction solvent in mixer/settler 20, while the light cracking products are removed from the process stream. In the mixer/settler 20, the pitch is separated into a heavy solvated pitch fraction and a light fraction plus solvent, which is removed from the reaction stream. The heavy fraction is then subjected to a solvated heat soak in a furnace 30, which heat soak may optionally be conducted in the presence of a heavier solvent. A heavy heat soaked solvated pitch is the desired product of the solvated heat soak step, while light cracking products and light solvents are removed from the process stream. The heavy heat soaked fraction is combined with more heavy solvent in a second mixer/settler 40 which separates the material into the desired heavy solvated pitch final product, and a lighter fraction which includes the extraction solvent which is removed from the product stream.

It will be appreciated by practitioners of the art that when starting with a heavy pitch fraction, like a mesophase pitch, the process shown in FIG. 1 can be simplified by removal of the feedstock heat soaking and first extraction portions of the process. Also, in another embodiment, the heat soaker 30 and the mixer/settler 40 may be combined in a single piece of processing equipment.

The present invention will be further illustrated in the Examples and Comparative Examples set forth below:

EXAMPLE 1

A sample of mid-continent refinery decant oil, with a nominal boiling point from 427°–482° C., was heat soaked for 3 hours at 441° C. at 60 psig in a nitrogen atmosphere. The yield of the heat soaked pitch was calculated to be 74.2%. Upon study with optical microscopy, the pitch was found to be 100% isotropic.

Extraction of the isotropic pitch was then carried out with the solvent xylene in a 5:1 solvent:pitch ratio at a temperature of 240° C. and a pressure of 105 psig. The extraction produced 19.0% xylene insolubles. When solvated, the xylene insolubles were found to be fluid at the extraction temperature of 240° C. A sample of the xylene insolubles from the extraction was dried to remove the xylene solvent. Melt testing of the dried xylene insolubles was carried out in a nitrogen atmosphere by heating the insolubles at the rate of 20° C./minute. Melt testing revealed that the dried xylene insolubles began to soften around 362° C. and melted at 381° C.

The dried xylene insolubles were placed in a closed container and heat soaked in the presence of 22 wt. % phenanthrene for 5 hours at 413° C. and under nitrogen at a pressure of 155 psig. This heat soaking step produced a solvated mesophase pitch which was determined by optical microscopy to be 98.3% mesophase. The solvated mesophase was calculated to contain approximately 20 wt. % phenanthrene. It was observed that the phenanthrene solvated pitch was a viscous fluid at 267° C. Dried pitch was found to soften at 408C and to melt at 470° C.

Extracting the phenanthrene solvated pitch from the second-stage heat soak with phenanthrene in a 1:1 solvent:pitch ratio (calculated on the basis of the pitch being dry) produced a solvated mesophase pitch at a yield of 45.9%. It was observed that this material was a viscous fluid at a temperature of 275° C. A dried sample of the pitch was tested and found to begin to soften at about 530° C. Maximum softening of the dried pitch was observed at about 549° C. At this temperature about 80% of the pitch sample appeared to have softened to the consistency of viscous glass. As the temperature was further elevated at the rate of 20° C. per minute, no melting or flow was observed. On continued heating to 600° C. the pitch solidified (thermoset).

The overall yield of thermosetting solvated mesophase pitch obtained from the distillate feedstock starting material is 6.1%.

COMPARATIVE EXAMPLE 1

Comparative Example 1 was conducted to illustrate that the isotropic heat soaked pitch used in Example 1 does not contain significant amounts of thermosetting mesogens prior to the second solvated heat soak step. A portion of the same 3 hour 441° C. heat soaked pitch as used in Example 1 was extracted for 30 minutes at 340° C. under a pressure of 122 psig using an 8:1 solvent-:pitch ratio. The solvent used in the extraction was a mixture of tetralin and phenanthrene in the ratio of 80:20, respectively.

This extraction yielded a solvated mesophase pitch in an amount of 3.9%. This yield corresponds to a 2.9% yield from the distillate feedstock.

The dried insolubles were heated under a nitrogen atmosphere at the rate of 20° C./minute. The insolubles were noted to begin to soften at 14° C. and to melt at 434° C. Higher melting thermosetting mesogens might have been obtained under more severe extraction conditions, but the overall yield of the pitch product would have been less than 2.9%.

COMPARATIVE EXAMPLE 2

Comparative Example 2 was conducted to show that extending the first heat soaking to produce significant amounts of thermosetting mesogens a two-phase pitch is produced. It will be recalled that a two phase pitch is difficult to process as it causes coking of the reactor and associated equipment.

The 427°–482° C. boiling mid-continent refinery decant oil distillate as used in Example 1 was heat soaked for 5.3 hours at 441° C. in a nitrogen atmosphere of 60 psig. The yield of the heat soaked pitch was calculated to be 71.8%. The heat soaked pitch produced a layer of mesophase pitch which clung to the reactor walls and was also suspended in the isotropic pitch. The total mesophase pitch content was estimated to be 2.5%.

The mesophase pitch produced by this process did not soften or melt upon heating under a nitrogen atmosphere at the rate of 20° C./minute to 600° C. Thus, the mixture of mesophase and isotropic pitches produced by this process would be too difficult (or impossible) to transfer from a heat soaking vessel to a mixer/extractor, resulting in a process that cannot be operated in an economical, continuous manner.

The pitch obtained in Comparative Example 2 was extracted for 30 minutes at 340° C. with a solvent in a ratio of 8 parts solvent to one part pitch. The solvent used was a mixture of tetralin and phenanthrene in a ratio of 80:20, respectively. It appears that all of the pitch became solvated. The solvated mesophase insolubles were collected and the yield of insolubles was calculated to be 14.7%. The 14.7% yield corresponds to a 10.6% overall yield from the distillate feed.

The insolubles were determined to be 100% anisotropic solvated mesophase. Melting tests conducted on the insolubles indicated they softened at 508C and melted at 542° C. The results indicate these materials are marginally thermosetting.

EXAMPLE 2

A portion of the thermosetting solvated pitch product of Example 1 was formed into filamentary carbon artifacts using the process of melt spinning. A sample of the pitch product of Example 1 was placed in a feed cylinder fitted with heaters and a movable piston. The pitch was heated to melting and pressure was applied with the piston to cause molten pitch to flow from a 4 mil diameter by 12 mil long capillary. The solvated pitch was spun at 870 psig and at 298° C. into fibers.

Under microscopic examination, the fibers formed by this process were comprised of elongated mesophase domains as are typically observed in high performance mesophase pitch carbon fibers.

What is claimed is:

1. A process yielding heavy solvated mesophase pitches comprising:

(a) combining a heavy aromatic pitch fraction and a solvating solvent;

(b) heat soaking said heavy aromatic pitch fraction in the presence of said solvating solvent under conditions for promoting the formation of larger heavy aromatic molecules, wherein such conditions include pressure sufficient to maintain said solvating solvent in the liquid state, while retaining sufficient solvent in the pitch fraction in order to generate a solvated mesophase pitch; and (c) recovering said solvated mesophase pitch comprising said larger heavy aromatic molecules formed in heat soaking and a sufficient portion of a solvating solvent to solvate said solvated mesophase pitch.

2. The process as claimed in claim 1, wherein the heat soaking conditions for promoting the formation of larger heavy aromatic molecules comprise subjecting the heavy aromatic pitch fraction to a temperature in the range of from 360°–520° C. and pressures in the range of from 14.7–1000 psia for a period of from 5 minutes to 24 hours.

3. The process as claimed in claim 2, wherein the temperature of the heat soak is in the range of from 380°–460° C.

4. The process as claimed in claim 1, wherein the solvating solvent is an aromatic organic solvent with a solubility parameter ($\delta$) in the range of from 7.0–11.5 and is one or more solvents selected from the group consisting of those solvents having a structure comprising from 1–4 aromatic rings, and those solvents having a structure comprising from 1–4 aromatic rings with from 1–3 hydroaromatic rings, wherein said solvating solvent may optionally be substituted with one or more alkyl substituents of from $C_1$–$C_4$.

5. The process as claimed in claim 4, wherein the solvating solvent is one or more solvents selected from the group consisting of benzene, xylene, anthracene, phenanthrene, chrysene, pyrene, tetralin, naphthalene, and naturally occurring aromatic distillates obtained from petroleum aromatics, coal tars, and ethylene tars.

6. The process as claimed in claim 1, wherein the solvating solvent is present during heat soaking in an amount of from 0.05–5.0 parts of solvating solvent per part of pitch by weight.

7. The process as claimed in claim 1, wherein recovering the larger heavy aromatic molecules is accomplished by solvent extraction.

8. The process as claimed in claim 7, wherein the conditions for separating the larger heavy aromatic molecules comprise contacting the larger heavy aromatic molecules with an extraction solvent in a ratio of solvent to pitch in the range of from 0.25–5.0 parts solvent per part of pitch by weight, at pressures of from 14.7–1000 psia, and a temperature of from 200°–520° C. to form a liquid extract phase and a solvated residue phase, wherein said solvated residue phase comprises the desired heavy aromatic molecules.

9. The process as claimed in claim 8, wherein said extraction solvent is an aromatic organic solvent with a solubility parameter (δ) in the range of from 7.0–11.5 and is one or more solvents selected from the group consisting of those solvents having a structure comprising from 1–4 aromatic rings, and those solvents having a structure comprising from 1–4 aromatic rings with from 1–3 hydroaromatic rings, wherein said solvating solvent may optionally be substituted with one or more alkyl substituents of from $C_1$–$C_4$.

10. The process as claimed in claim 9, wherein the extraction solvent is one or more solvents selected from the group consisting of benzene, xylene, anthracene, phenanthrene, chrysene, pyrene, tetralin, naphthalene, and naturally occurring aromatic distillates obtained from petroleum aromatics, coal tars, and ethylene tars.

11. The process as claimed in claim 1, wherein steps (a) and (b) are combined and are carried out in the presence of a sufficient amount of solvating solvent so that said steps occur simultaneously.

12. The process as claimed in claim 11, wherein the amount of solvating solvent is in the range of 0.25–5.0 parts solvent per part of pitch by weight.

13. The process as claimed in claim 11, wherein the solvating solvent is an aromatic organic solvent with a solubility parameter (δ) in the range of from 7.0–11.5 and is one or more solvents selected from the group consisting of those solvents having a structure comprising from 1–4 aromatic rings, and those solvents having a structure comprising from 1–4 aromatic rings with from 1–3 hydroaromatic rings, wherein said solvating solvent may optionally be substituted with one or more alkyl substituents of from $C_1$–$C_4$.

14. The process as claimed in claim 13, wherein the solvating solvent is one or more solvents selected from the group consisting of benzene, xylene, anthracene, phenanthrene, chrysene, pyrene, tetralin, naphthalene, and naturally occurring aromatic distillates obtained from petroleum aromatics, coal tars, and ethylene tars.

15. The process as claimed in claim 11, wherein the process is carried out at a temperature in the range of from 360°–520° and at a pressure in the range of 14.7–1000 psia.

16. A process yielding heavy solvated mesophase pitches comprising:

(a) heat soaking an aromatic feedstock to obtain an isotropic heat soaked pitch therefrom which comprises a heavy pitch fraction;

(b) extracting and isolating the heavy pitch fraction of the isotropic heat soaked pitch using a suitable solvent;

(c) combining said heavy aromatic pitch fraction and a solvating solvent;

(d) heat soaking the heavy pitch fraction in the presence of said solvating solvent under conditions for promoting the formation of larger heavy aromatic molecules, wherein such conditions include pressure sufficient to maintain said solvating solvent in the liquid state, while retaining sufficient solvent in the pitch fraction order to generate a solvated mesophase pitch; and (e) recovering said solvated mesophase pitch comprising said larger heavy aromatic molecules produced in heat soaking the heavy fraction and a sufficient portion of a solvating solvent to solvate said solvated mesophase pitch.

17. The process as claimed in claim 16, wherein the heat soaking conditions for promoting the formation of larger heavy aromatic molecules in step (c) comprise subjecting the heavy aromatic pitch fraction to a temperature in the range of 360°–520° C. and pressures in the range of 14.7–1000 psia for a period of time from 5 minutes to 24 hours.

18. The process as claimed in claim 17, wherein the temperature of the heat soak is preferably in the range of 380°–460° C.

19. The process as claimed in claim 16, wherein the amount of solvating solvent of step (c) is in the range of 0.25–5.0 parts solvent per part of pitch by weight.

20. The process as claimed in claim 16, wherein the solvating solvent of step (c) is an aromatic organic solvent with a solubility parameter (δ) in the range of from 7.0–11.5 and is one or more solvents selected from the group consisting of those solvents having a structure comprising from 1–4 aromatic rings, and those solvents having a structure comprising from 1–4 aromatic rings with from 1–3 hydroaromatic rings, wherein said solvating solvent may optionally be substituted with one or more alkyl substituents of from $C_1$–$C_4$.

21. The process as claimed in claim 20, wherein the solvating solvent is one or more solvents selected from the group consisting of benzene, xylene, anthracene, phenanthrene, chrysene, pyrene, tetralin, naphthalene, and naturally occurring aromatic distillates obtained from petroleum aromatics, coal tars, and ethylene tars.

22. The process as claimed in claim 16, wherein steps (c) and (d) are combined and are carried out in the presence of a sufficient amount of solvating solvent so that said steps occur simultaneously.

23. The process as claimed in claim 22, wherein the solvating solvent is an aromatic organic solvent with a solubility parameter (δ) in the range of from 7.0–11.5 and is one or more solvents selected from the group consisting of those solvents having a structure comprising from 1–4 aromatic rings, and those solvents having a structure comprising from 1–4 aromatic rings with from 1–3 hydroaromatic rings, wherein said solvating solvent may optionally be substituted with one or more alkyl substituents of from $C_1$–$C_4$.

24. The process as claimed in claim 23, wherein the solvating solvent is one or more solvents selected from the group consisting of benzene, xylene, anthracene, phenanthrene, chrysene, pyrene, tetralin, naphthalene, and naturally occurring aromatic distillates obtained from petroleum aromatics, coal tars, and ethylene tars.

25. The process as claimed in claim 22, wherein the process is carried out at a temperature in the range of from 360°–520° C. and at a pressure in the range of 14.7–1000 psia.

26. The process as claimed in claim 1, wherein said process is a batch process.

27. The process as claimed in claim 1, wherein said process is a continuous process.

28. The process as claimed in claim 11, wherein said process is a batch process.

29. The process as claimed in claim 11, wherein said process is a continuous process.

30. The process as claimed in claim 16, wherein said process is a batch process.

31. The process as claimed in claim 16, wherein said process is a continuous process.

32. The process as claimed in claim 22, wherein said process is a batch process.

33. The process as claimed in claim 22, wherein said process is a continuous process.

34. The process as claimed in claim 16, wherein the solvating solvent used in the heat soaking step (c) is a different solvent than is used in the extracting and isolating step (b).

35. The process as claimed in claim 34, wherein the solvating solvent used in step (c) is higher boiling than the solvent used in step (b), and after the addition of the higher boiling solvating solvent the lower boiling solvent of step (b) is allowed to boil off.

* * * * *

UNITED STATES PATENT AND TRADEMARK OFFICE

CERTIFICATE OF CORRECTION

PATENT NO. : 5,437,780

DATED : August 1, 1995

INVENTOR(S) : W. Mark Southhard, H. Ernest Romine, Edward J. Nanni, and Mark W. Carel It is certified that error appears in the above-indentified patent and that said Letters Patent is hereby corrected as shown below:

Column 1, line 6, "relate" should be --relates--.

Column 1, line 62, "goo" should be --good--.

Column 2, line 45, after the word "without", the word "first" was inadvertently omitted.

Column 3, line 51, "solvent" should be --solvents--.

Column 3, line 59, "(8)" should be --$\delta$--.

Column 5, line 6, "200" should be --200$\mu$--.

Column 9, line 18, "14°C" should be --414°C--.

Signed and Sealed this

Twenty-first Day of November, 1995

Bruce Lehman

*Attest:*

BRUCE LEHMAN

*Attesting Officer*

*Commissioner of Patents and Trademarks*